US006304160B1

(12) United States Patent
Loi et al.

(10) Patent No.: US 6,304,160 B1
(45) Date of Patent: Oct. 16, 2001

(54) COUPLING MECHANISM FOR AND FILTER USING $TE_{011}$ AND $TE_{01\delta}$ MODE RESONATORS

(75) Inventors: Keith N. Loi, Rosemead; Paul J. Tatomir, Laguna Niguel, both of CA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/304,458

(22) Filed: May 3, 1999

(51) Int. Cl.[7] ..... H01P 1/20; H01P 7/06

(52) U.S. Cl. ..... 333/212; 333/202; 333/230

(58) Field of Search ..... 333/202, 203, 333/206, 208, 212, 230

(56) References Cited

U.S. PATENT DOCUMENTS 4,453,146 * 6/1984 Fiedziuszko ..... 333/212
5,608,363 * 3/1997 Cameron et al. ..... 333/202
5,684,438 * 11/1997 Cavalieri D'Oro et al. ..... 333/230
5,841,330 * 11/1998 Wenzel et al. ..... 333/212
6,150,907 * 11/2000 Loi et al. ..... 333/212

* cited by examiner

*Primary Examiner*—Benny Lee
*Assistant Examiner*—Patricia T. Nguyen
(74) *Attorney, Agent, or Firm*—Terje Gudmestad

(57) ABSTRACT

A cavity-coupled microwave filter that uses $TE_{011}$ and $TE_{01\delta}$ mode resonators. The cavity-coupled microwave filter includes an input port, a first resonator having a first opening, wherein the first opening receives electromagnetic energy from the input port, a second resonator having a second opening, wherein the second opening receives electromagnetic energy from the input port and wherein the first resonator and the second resonator are electromagnetically coupled. The cavity-coupled microwave filter further includes an output port, a third resonator having a third opening, wherein the third opening transfers electromagnetic energy to the output port and wherein the second resonator and the third resonator are electromagnetically coupled and a fourth resonator having a fourth opening, wherein the fourth opening transfers electromagnetic energy to the output port and wherein the third resonator and the fourth resonator are electromagnetically coupled. By using both positive and negative coupling between resonators and filter ports, both high side and low side transmission poles are created, thereby yielding a bandpass filter.

16 Claims, 14 Drawing Sheets

FIG. 1
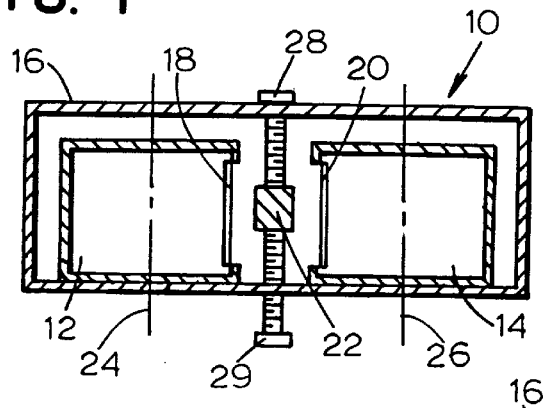
FIG. 2
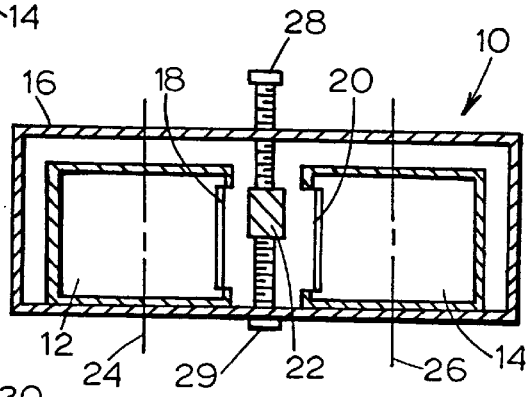
FIG. 3
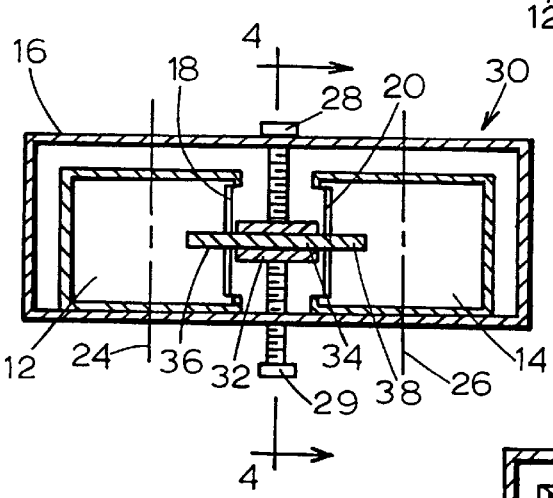
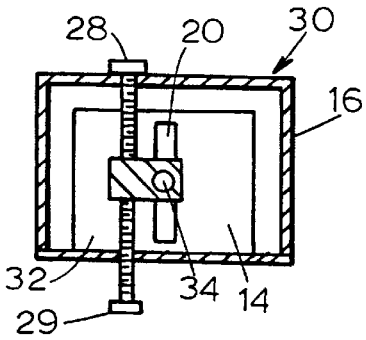
FIG. 4
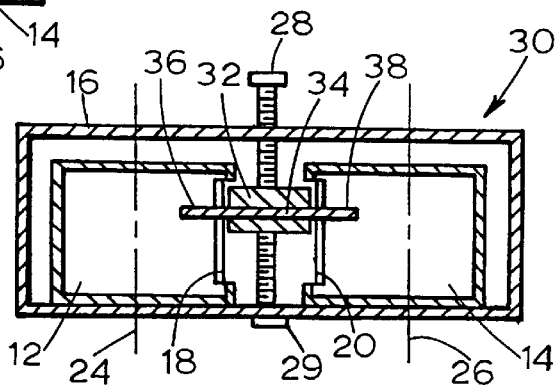
FIG. 5

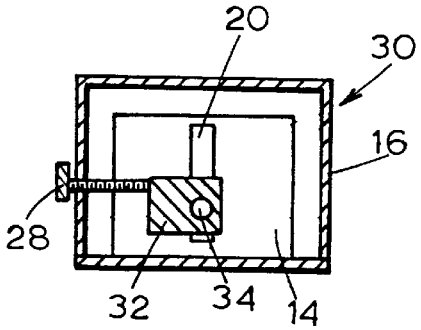
FIG. 6
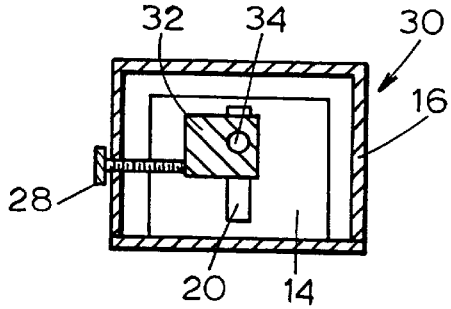
FIG. 7
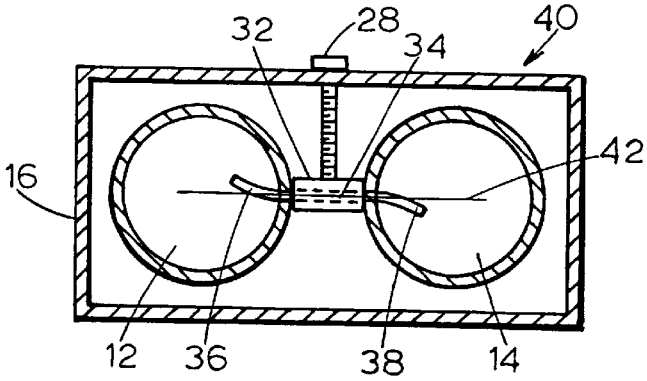
FIG. 8
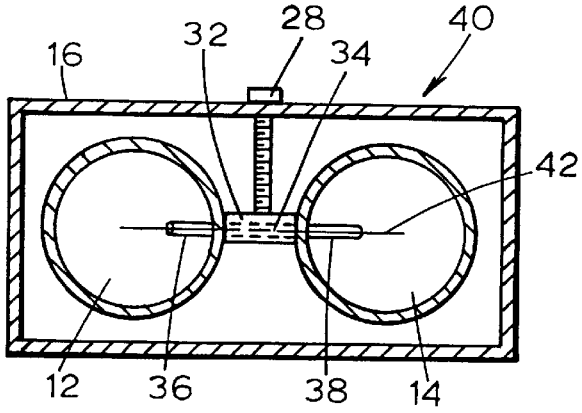
FIG. 9
FIG. 10
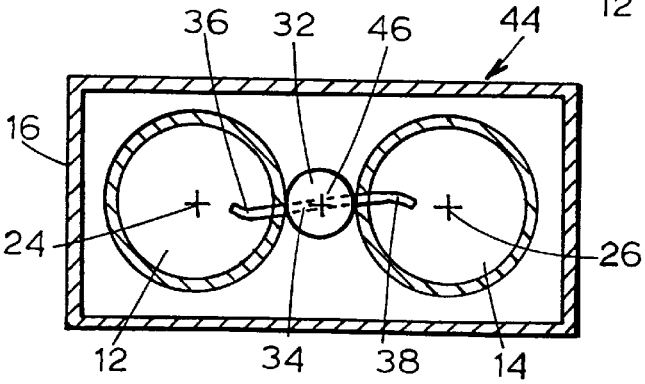

COUPLING MECHANISM FOR AND FILTER USING $TE_{011}$ AND $TE_{01\delta}$ MODE RESONATORS

BACKGROUND OF THE INVENTION

1. Field of the Invention

The present invention relates generally to cavity resonators and, more particularly, to coupling mechanisms for, and a filter using, $TE_{01\delta}$ and $TE_{011}$ mode resonators.

2. Description of the Related Art

In numerous electrical devices, such as electromagnetic filters, pairs of resonators are coupled together to pass electromagnetic energy from one resonator to the other resonator. The electromagnetic frequency response of individual resonators allows multiple resonators to be connected to create an electromagnetic filter having a desired frequency response. Currently, several different mechanisms are used to couple resonators. In one arrangement used for cylindrical $TE_{011}$ and $TE_{01\delta}$ mode resonators, each of the resonators has a slot in the longitudinal direction that exposes the internal cavity of the resonator to an external environment. The resonators are positioned in close proximity to each other with the slots aligned to couple magnetic fields within the resonators, thereby facilitating communication of the electromagnetic energy between the resonators.

In another arrangement, the resonators are connected by a conductive filament. The end portions of the filament form probes that extend into the inner cavities of the resonators. In this arrangement, the electromagnetic field in one resonator creates a current in the filament which, in turn, creates an electromagnetic field in the other resonator.

In coupling arrangements such as those described above, the coupling mechanism cannot be adjusted after assembly is complete. The electromagnetic field created in the second resonator may be out of phase with the electromagnetic field in the first resonator by a given amount which is determined by the characteristics of the coupling mechanism. This phase difference is constant regardless of the magnitude of the electromagnetic field in the first resonator. Additionally, the magnitude of the electromagnetic field in the second resonator is varied only by varying the magnitude of the electromagnetic field in the first resonator. In this way, the operation of the coupled resonators is set when the resonators are coupled together.

Therefore, there is a need for an improved coupling mechanism for $TE_{011}$ and $TE_{01\delta}$ resonators that provides an adjustable coupling between the resonators, and which allows adjustment of the magnitude and/or phase of the electromagnetic energy passed from the first resonator to the second resonator. A need also exists for improved coupling mechanisms that couple two resonators with waveguides to provide control of the relative coupling of the electromagnetic energy that is transferred between the waveguide and the coupled resonators.

SUMMARY OF THE INVENTION

The present invention may be embodied in a coupled-cavity microwave filter including an input port; a first resonator having a first opening, wherein the first opening receives electromagnetic energy from the input port; and a second resonator having a second opening, wherein the second opening receives electromagnetic energy from the input port and wherein the first resonator and the second resonator are electromagnetically coupled. The present invention may also include an output port; a third resonator having a third opening, wherein the third opening transfers electromagnetic energy to the output port and wherein the second resonator and the third resonator are electromagnetically coupled; and a fourth resonator having a fourth opening, wherein the fourth opening transfers electromagnetic energy to the output port and wherein the third resonator and the fourth resonator are electromagnetically coupled.

In some embodiments, the first opening may be a first distance from the input port while the second opening may be a second distance from the input port, and the third opening may be a third distance from the output port while the fourth opening may be a fourth distance from the output port.

In certain embodiments the first distance may be approximately equal to the second distance, thereby creating positive coupling. In other embodiments, a difference between the first distance and the second distance may be approximately one-half of a wavelength at which the first and second resonators operate, thereby creating negative coupling.

In certain other embodiments, the third distance may be approximately equal to the fourth distance, thereby creating positive coupling. Whereas, in other embodiments a difference between the third distance and the fourth distance may be approximately one-half of a wavelength at which the third and fourth resonators operate, thereby creating negative coupling.

In some embodiments, the second resonator may be directly coupled to the third resonator. In other embodiments, the second resonator may be coupled to the third resonator through a plurality of resonators, which may include four resonators.

In any of the foregoing embodiments, the first, second, third and fourth resonators may be tuned to operate at approximately a single frequency.

The first and second resonators may be electromagnetically coupled through an opening including tuning screws to adjust the coupling between the resonators. Additionally the third and fourth resonators may be electomagnetically coupled through an opening, which may include tuning screws to adjust the coupling between the resonators. Moreover, tuning screws may also be disposed in each of the first, second, third and fourth openings.

The features and advantages of the invention will be apparent to those of ordinary skill in the art in view of the detailed description of the preferred embodiment, which is made with reference to the drawings, a brief description of which is provided below.

BRIEF DESCRIPTION OF THE DRAWINGS

FIG. 1 is a front elevation sectional view of two $TE_{011}$ mode cylindrical cavity resonators coupled with an adjustable dielectric rod in a first position;

FIG. 2 is a front elevation sectional view of two $TE_{011}$ mode resonators coupled by an adjustable dielectric rod in a second position;

FIG. 3 is a front elevation sectional view of two $TE_{011}$ mode resonators coupled by an adjustable conductive filament in a first position;

FIG. 4 is a side elevation sectional view taken along line 4—4 of an adjustable conductive filament coupling mechanism;

FIG. 5 is a front elevation sectional view of two $TE_{011}$ mode resonators coupled by an adjustable filament in a second position;

FIG. 6 is a side elevation sectional view of an alternative embodiment of the adjustable conductive filament of FIG. 4 in a first position;

FIG. 7 is a side elevation sectional view of an alternative embodiment of the adjustable conductive filament of FIG. 4 in a second position;

FIG. 8 is a top sectional view of two $TE_{011}$ mode resonators coupled by a rotatably adjustable filament in a first position;

FIG. 9 is a top sectional view of two $TE_{011}$ mode resonators coupled by a rotatably adjustable filament in a second position;

FIG. 10 is a top sectional view of two $TE_{011}$ mode resonators coupled by an alternative rotatably adjustable filament in a first position;

DETAILED DESCRIPTION OF THE PREFERRED EMBODIMENTS

Figure 11:
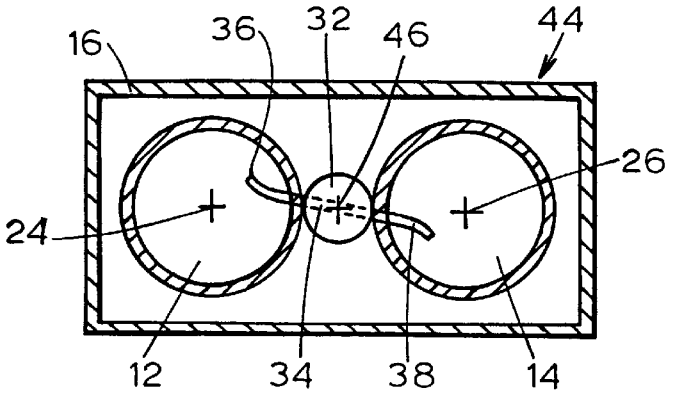
FIG. 11 is a top sectional view of two $TE_{011}$ mode resonators coupled by an alternative rotatably adjustable filament in a second position.

A first embodiment of a coupling mechanism 10 for two $TE_{011}$ mode cylindrical cavity resonators 12, 14 is shown in FIGS. 1 and 2. Referring to FIG. 1, the resonators 12, 14 are positioned side-by-side in a housing 16. The resonators 12, 14 have corresponding slots 18, 20 in their outer walls which are aligned with a dielectric rod 22 along a line between the center lines 24, 26 of the resonators 12, 14. The dielectric rod 22 adjusts the cutoff frequency of the slots 18, 20 by moving up and down in a direction parallel to the center lines 24, 26 of the resonators 12, 14. A pair of screws 28, 29 are inserted through the top and bottom of the housing 16 and engage the dielectric rod 22.

When the screws 28, 29 are turned in the appropriate direction, the screws 28, 29 cause the dielectric rod 22 to slide upwardly within the slots 18, 20 between the first position illustrated in FIG. 1 and the second position illustrated in FIG. 2. Turning the screws 28, 29 in the other direction will cause the dielectric rod 22 to move downwardly from the second position illustrated in FIG. 2 to the first position illustrated in FIG. 1. It will be obvious to those of ordinary skill in the art that the double-screw arrangement shown in FIGS. 1 and 2 can be replaced by a single screw with the dielectric rod 22 affixed to the end, or by using a dielectric screw that extends into the area between the slots 18, 20. These alternatives are contemplated by the inventors as having use in connection with the present invention.

The movement of the dielectric rod 22 between the first and second positions changes the magnitude and phase of the electromagnetic energy transferred between the resonators 12, 14. The magnitude of the magnetic field in the resonator 12 is greatest at the cylindrical wall in the longitudinal center of the resonator 12, and decreases toward the top and bottom of the resonator 12. As the dielectric rod 22 moves from the first position of FIG. 1 towards the second position of FIG. 2, the distance between the dielectric rod 22 and the center of the resonators 12, 14 increases. Consequently, the magnitude of the electromagnetic energy transferred between the resonators 12, 14 decreases. Additionally, the increased distance the electromagnetic energy travels between the center of the first resonator 12 and the second resonator 14 increases the phase shift between the electromagnetic fields in the resonators 12, 14.

The coupling mechanisms discussed and illustrated herein can be used in a similar manner to couple a pair of cylindrical cavity resonators containing dielectric pucks, also known as $TE_{01\delta}$ mode resonators. The effects of using dielectric pucks in cavity resonators to alter the impedance of the resonators are well known to those in the art. Therefore, the use of the coupling mechanisms described herein to couple $TE_{01\delta}$ mode resonators will be obvious to those of ordinary skill in the art and is contemplated by the inventors in connection with the present invention. Additionally, the positioning of the dielectric pucks within the resonators may be adjustable in both the longitudinal and radial directions through the use of dielectric set screws, and is also contemplated by the inventors in connection with the present invention.

FIGS. 3–5 illustrate a second embodiment of a coupling mechanism 30. As discussed in the previous embodiment, a pair of resonators 12, 14 are placed side by side within a housing 16 with corresponding slots 18, 20 in the outer surfaces of the resonators 12, 14. In this embodiment, the dielectric rod 22 of the coupling mechanism 10 is replaced by a support member 32 and a conductive filament 34, which is fabricated from a highly conductive material such as silver or copper. The filament 34 runs through the length of the support member 32, and extends beyond the support member 32 through the slots 18, 20 to form probes 36, 38 within the cavities of the resonators 12, 14, respectively. The support member 32 is engaged by the screw 28 to facilitate the sliding of the support member 32 and the filament 34 within the slots 18, 20 as illustrated in FIG. 4. In this embodiment, the support member 32 and the screws 28, 29 are either metallic or fabricated from a dielectric plastic, such as Ultem®.

By rotating the screws 28,29 in one direction, the support member 32 and filament 34 slide from the first position illustrated in FIG. 3 to the second position shown in FIG. 5. Rotating the screws 28, 29 in the opposite direction will then move the support member 32 of the filament 34 from the second position illustrated in FIG. 5 to the first position illustrated in FIG. 3. Movement of the support member 32 and the filament 34 in this manner will have a similar affect on the magnitude and phase of the electromagnetic energy passed between the resonators 12, 14 as described previously in relation to the dielectric rod of the coupling mechanism 10.

FIGS. 6 and 7 illustrate an alternative embodiment for the coupling mechanism 30 where the screw 28 functions as a set screw which is tightened to engage support member 32 when the support member 32 and filament 34 are manually moved into the desired position. Initially, the screw 28 holds the support member 32 in the first position illustrated in FIG. 6. The screw 28 is then unscrewed to free the support member 32 for slidable movement of the filament 34 in the slots 18, 20. The support member 32 is moved to a second position as illustrated in FIG. 7, by removing a top wall of the housing (not shown) and manually sliding the support member 32. The screw 28 is retightened to once again engage the support member 32, thereby holding it in the second position.

FIGS. 8 and 9 illustrate another embodiment of a coupling mechanism 40. In this embodiment, the support member 32 is cylindrically shaped with an axis of rotation around of the points where the probes 36, 38 enter the resonators 12, 14, respectively. The probes 36, 38 have a non-linear shape whereby the ends of the probes 36, 38 are positioned off the axis of rotation 42 of the support member 32. The screw 28 acts as a set screw which is tightened to retentively engage the support member 32 after the support member 32 is rotated to the desired position. In order to adjust the positioning of the support member 32 and the filament 34, the screw 28 is loosened to allow the support member 32 to rotate from a first position as shown in FIG. 8 to a second position as shown in FIG. 9, shown here to be a relative rotation of approximately 90° from the first to the second position. Once in the desired position, the screw 28 is again tightened to retentively engage the support member 32 to prevent further rotation.

In the coupling mechanism 44 illustrated in FIGS. 10 and 11, the dielectric support member 32 is cylindrically shaped with an axis of rotation 46 aligned parallel to the center lines 24, 26 of the resonators 12, 14, respectively, and lies along a line between the center lines 24, 26. A set screw (not shown) enters through either the top or the bottom of the housing 16 and engages the support member 32 to fix the support member 32 at a fixed point of rotation about the axis 46. The probes 36, 38 have a non-liner shape and enter the resonators 12, 14 through slots which are aligned perpendicular to the axis 46 and the center lines 24, 26. In order to adjust the positioning of the support member 32 and the filament 34, the set screw 28 is loosened to allow the support member 32 to rotate from a first position as shown in FIG. 10 to a second position as shown in FIG. 11. Once in the desired position, the screw 28 is again tightened to retentively engage the support member 32 to prevent further rotation.

Figure 12:
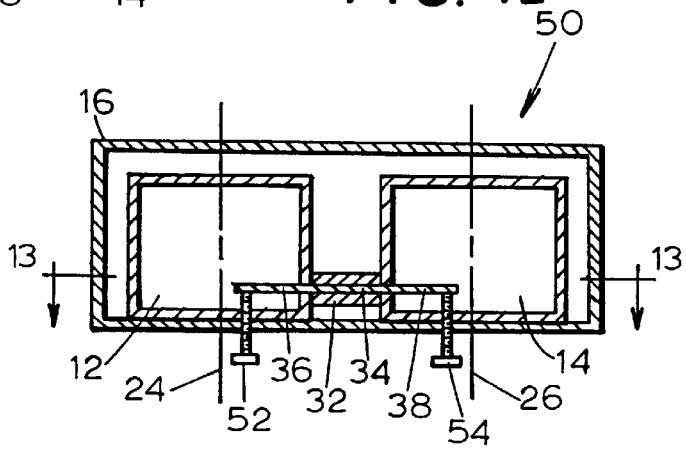
FIG. 12 is a front elevation sectional view of two $TE_{011}$ mode resonators coupled by an adjustable filament in a first position.
Figure 13:
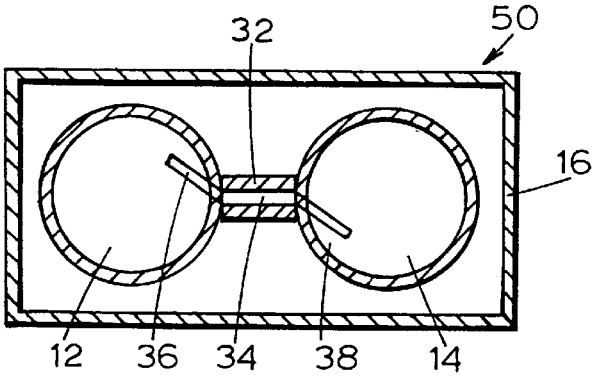
FIG. 13 is a top sectional view taken along line 13—13 of two $TE_{011}$ mode resonators coupled by an adjustable filament.
Figure 14:
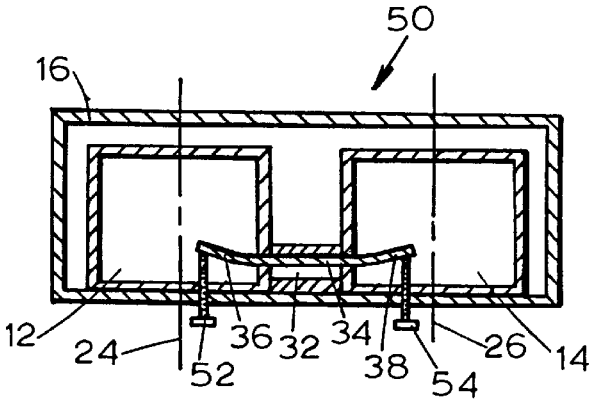
FIG. 14 is front elevation sectional view of two $TE_{011}$ mode resonators coupled by an adjustable filament deflected to a second position.

Yet another embodiment of a coupling mechanism 50 is shown in FIGS. 12–14. In this embodiment, the cylindrical cavity resonators 12, 14 are coupled by the filament 34 enclosed in the support member 32. The probes 36, 38 enter the resonators 12, 14, respectively, along non-diametral cords as illustrated in FIG. 13. Dielectric screws 52, 54 are inserted through the housing 16 and into the resonators 12, 14, respectively, and abut the probes 36, 38, respectively. By rotating the dielectric screws 52, 54 in one direction, the dielectric screws 52, 54 deflect the probes 36, 38 from the first position as shown in FIG. 12 to a second deflected position as shown in FIG. 14. By turning the dielectric screws 52, 54 in the opposite direction, the probes 36, 38 are returned from the second position of FIG. 14 to the initial position shown in FIG. 12. As discussed in relation to the previous embodiments, by varying the distance between the probes 36, 38 and the centers of the resonators 12, 14 in this manner, the magnitude of the electromagnetic energy transferred between the resonators 12, 14 can be adjusted to reach a desired value.

Figure 15:
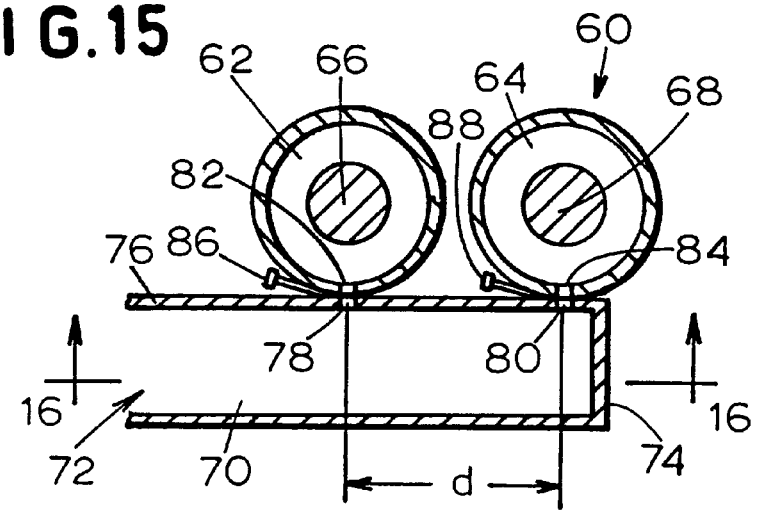
FIG. 15 is a top sectional view of two $TE_{01\delta}$ mode resonators coupled in parallel by a waveguide for negative relative coupling.
Figure 16:
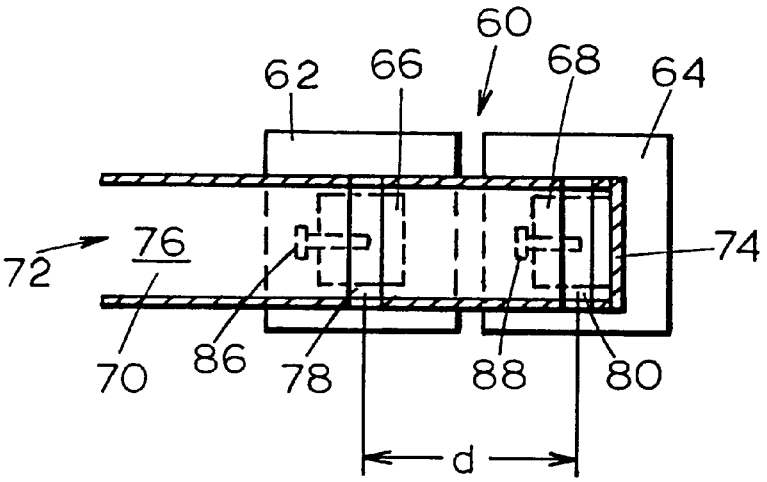
FIG. 16 is a side sectional view taken along line 16—16 of two $TE_{01\delta}$ mode resonators coupled in parallel by a waveguide for negative relative coupling.
Figure 17:
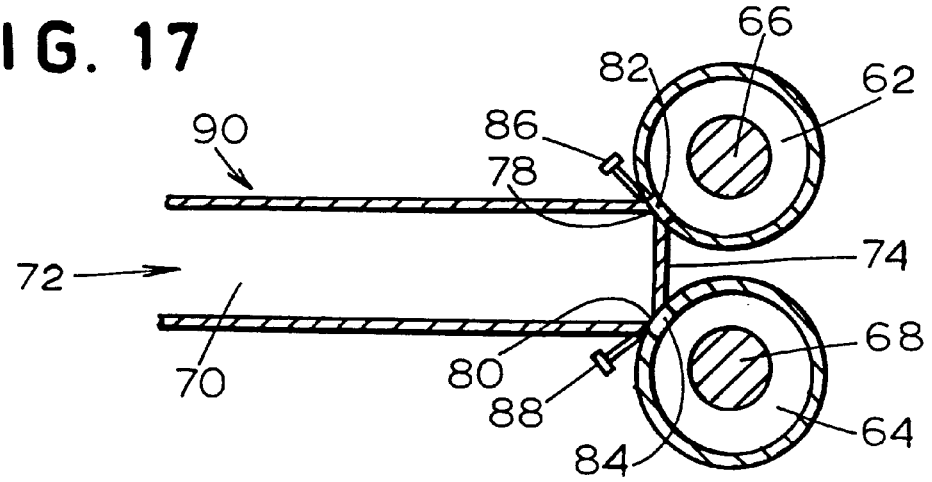
FIG. 17 is a top sectional view of two $TE_{01\delta}$ mode resonators coupled in parallel by a waveguide for positive relative coupling.

FIGS. 15–17 illustrate alternative embodiments, wherein $TE_{01\delta}$ mode resonators 62, 64 containing dielectric pucks 66, 68 are coupled by a waveguide 70. The open end 72 of the waveguide 70 provides either an input for electromagnetic energy that is transferred into the resonators 62, 64, or an output for the combined electromagnetic energy created by the electromagnetic fields of the resonators 62, 64. Referring to FIGS. 15–16, the coupling mechanism 60 achieves negative relative coupling of the resonators 62, 64 when the resonators 62, 64 are coupled to an outer wall 76 of the waveguide 70. The outer wall 76 has first and second apertures 78, 80 to which corresponding slots 82, 84 of the resonators 62, 64, respectively, are coupled. This coupling forms an electromagnetic connection that facilitates the transfer of electromagnetic energy between the resonators 62, 64 and the waveguide 70. Dielectric or metallic screws 86, 88, are inserted into the coupled apertures 78, 80 and slots 82, 84, respectively, to provide adjustment of the magnitude of the electromagnetic energy transferred between the waveguide 70 and the resonators 62, 64.

Negative relative coupling is achieved in the coupling mechanism 60 when the apertures 78, 80 are separated by a distance d equal to one-half the wavelength of the resonant frequency of the resonators 62, 64. When electromagnetic energy is input to the waveguide 70 at end 72, the electromagnetic energy enters the first resonator 62 through the aperture 78 and slot 82, thereby creating an electromagnetic field in the resonator 62 having the resonant frequency of the resonator 62. The electromagnetic energy travels an additional one-half wavelength to cover the distance d before entering the second resonator 64 through aperture 80 and slot 84. The electromagnetic energy creates an electromagnetic field in the second resonator 64 having the same resonant frequency as the first resonator 62, but is 180° out of phase relative to the electromagnetic field in the first resonator 62 due to the added distance d.

Negative relative coupling is also achieved in the opposite direction in the waveguide coupling mechanism 60. When electromagnetic energy is input to the resonators 62, 64, electromagnetic fields are created which are in phase. The resonator 64 outputs a first output electromagnetic energy having the resonant frequency to the waveguide 70 across the coupling at slot 84 and aperture 80. The first output electromagnetic energy travels the distance d and combines with a second output electromagnetic energy also having the resonant frequency which enters the waveguide 70 from the resonator 62 across the coupling at slot 82 and aperture 78. At the point where the first and second output energies combine, the first and second output electromagnetic energies are 180° out of phase. The combined output electromagnetic energy is then supplied to a load coupled to the end 72 of the waveguide 70.

FIG. 17 illustrates an alternative waveguide coupling mechanism 90 wherein positive relative coupling is achieved. Positive relative coupling of the resonators 62, 64 occurs when the resonators 62, 64 are coupled to the waveguide 70 at equal longitudinal distances from the open end 72. As shown in FIG. 17, this can occur when the resonators 62, 64 are coupled to the end wall 74. The end wall 74 has first and second apertures 78, 80 to which corresponding slots 82, 84 of the resonators 62, 64, respectively, are coupled. This coupling forms an electromagnetic connection that facilitates the transfer of electromagnetic energy between the resonators 62, 64 and the waveguide 70. Dielectric or metallic screws 86, 88 are inserted into the coupled apertures 78, 80 and slots 82, 84, respectively, to provide adjustment of the magnitude of the electromagnetic energy transferred between the waveguide 70 and the resonators 62, 64.

When electromagnetic energy is input to the waveguide 70 at end 72, the input energy travels the same distance before entering the resonators 62, 64 through the apertures 78, 80 and slots 82, 84, respectively, thereby creating electromagnetic fields in the resonators 62, 64 having the resonant frequency of the resonators. Because the input electromagnetic energy travels the same distance from the end 72 to both resonators 62, 64, the electromagnetic fields created in the resonators 62, 64 are in phase. Similarly, if electromagnetic fields are created in the resonators 62, 64 by inputting electromagnetic energy, and the fields are in phase, the first and second output electromagnetic energies transferred to the waveguide through the slots 82, 84 and the apertures 78, 80 are also in phase, thereby resulting in positive relative coupling of the output electromagnetic energy.

Figure 18:
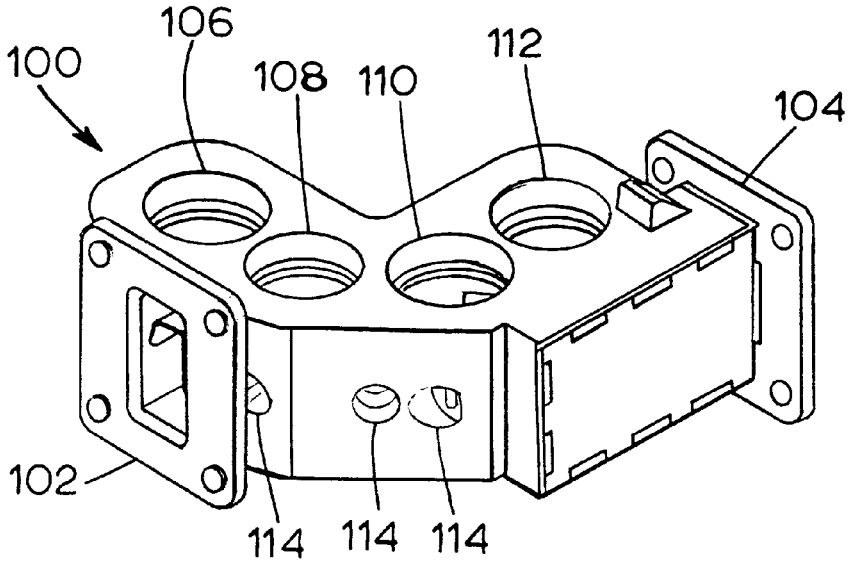
FIG. 18 is an isometric view of a filter constructed in accordance with the teachings of the present invention.

FIG. 18 is an isometric view of a filter 100 constructed in accordance with the teachings of the present invention. The filter 100 includes an input port 102, an output port 104, a plurality of resonant cavities 106, 108, 110, 112 and a number of screw bores 114 to accommodate tuning screws (not shown). The filter 100 is connected into a microwave circuit using waveguides (not shown) that connect to the input and output ports 102, 104. In a preferred embodiment, the filter 100 may be fabricated from bare aluminum. Alternatively, the filter 100 may be fabricated from any material having good electrical conductivity (e.g., copper, silver, etc.) In some embodiments, the filter 100 may be fabricated from a synthetic material such as plastic so long as it is plated with an electrically conductive material.

Figure 19:
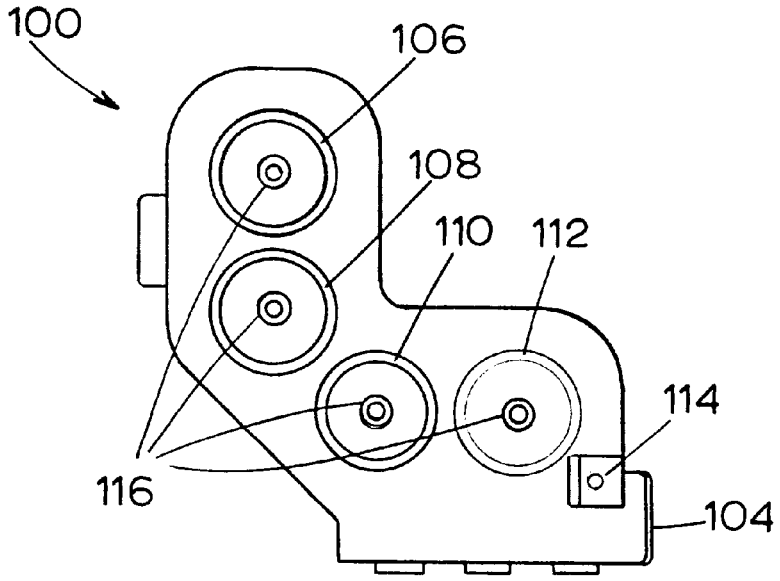
FIG. 19 is a plan view of the filter of FIG. 18.
Figure 20:
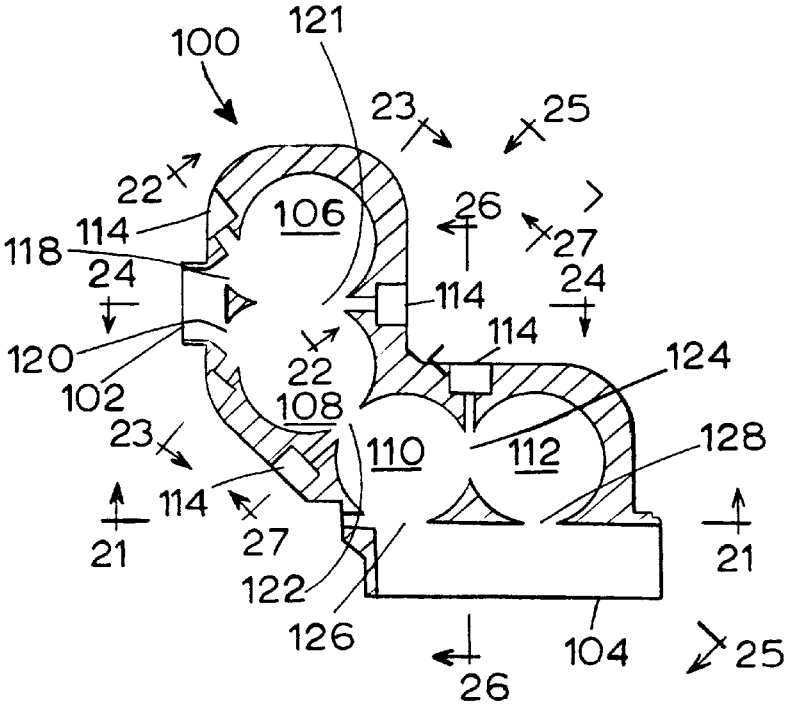
FIG. 20 is a sectional plan view of the filter of FIG. 18.
Figure 21:
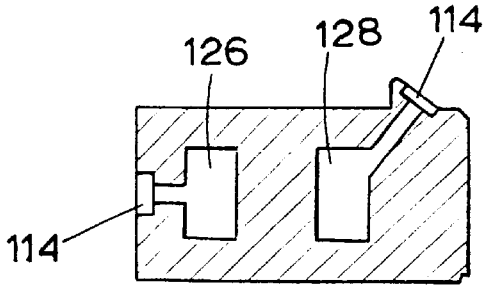
FIG. 21 is a sectional view of the filter shown in FIG. 20 taken along line 21—21.
Figure 22:
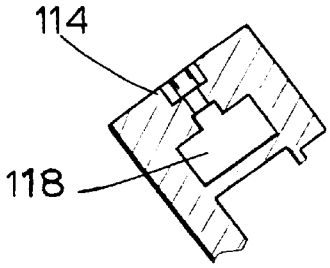
FIG. 22 is a sectional view of the filter shown in FIG. 20 taken along line 22—22.
Figure 23:
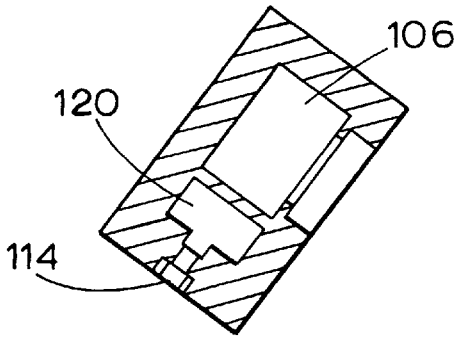
FIG. 23 is a sectional view of the filter shown in FIG. 20 taken along line 23—23.
Figure 24:
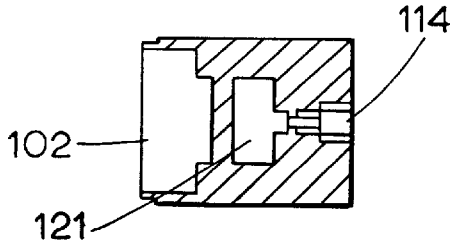
FIG. 24 is a sectional view of the filter shown in FIG. 20 taken along line 24—24.
Figure 25:
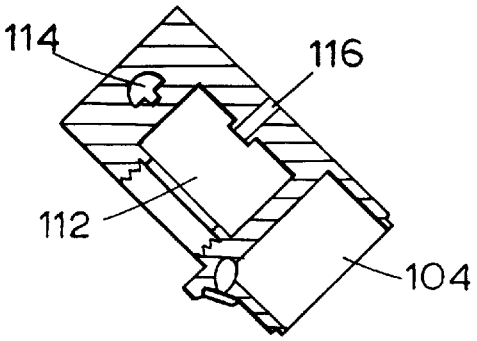
FIG. 25 is a sectional view of the filter shown in FIG. 20 taken along line 25—25.
Figure 26:
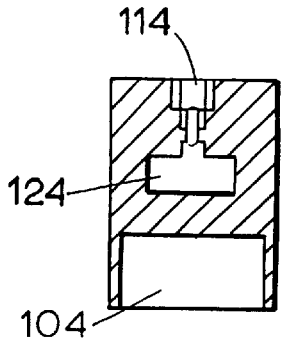
FIG. 26 is a sectional view of the filter shown in FIG. 20 taken along line 26—26.
Figure 27:
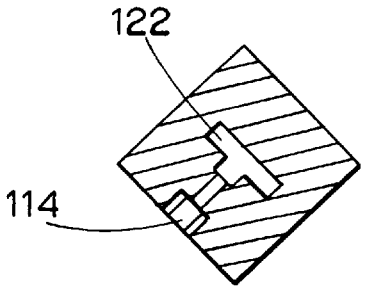
FIG. 27 is a sectional view of the filter shown in FIG. 20 taken along line 27—27.

As shown in FIG. 19, all of the resonant cavities (also called resonators) 106, 108, 110, 112 are identical in size and, therefore, are tuned to the same resonant frequency and may include an number of bores 116, which accommodate screws that may be used to retain dielectric pucks (not shown) within the resonant cavities. Dielectric pucks enable the resonant cavities 106–112 to support $TE_{01\delta}$ mode electromagnetic energy. The use of screws to retain the dielectric pucks allows the position of the pucks within the resonant cavities 106–112 to be adjusted for optimal filter performance. The use of dielectric pucks is optional and the omission of the pucks allows the resonant cavities 106–112 to support $TE_{011}$ mode electromagnetic energy. The filter 100 shown in FIG. 19 is a fourth order filter because it uses four resonators. As will be described later, the techniques of the present invention may be applied to filters of higher order.

Referring now to FIGS. 20–27, the physical relationships between the various resonant cavities 106–112, the input port 102, the output port 104 and the screw bores 114 are shown. The input port 102 is connected to resonant cavities 106 and 108 through slots or windows (referred to hereinafter as openings) 118 and 120. Resonant cavities 106 and 108 are coupled together via an opening 121. Resonant cavity 108 is coupled to resonant cavity 110 via an opening 122. Resonant cavity 110 is coupled to resonant cavity 112 via an opening 124 and is further coupled to the output port 104 via an opening 126. Resonant cavity 112 is coupled to the output port 104 via an opening 128, which is physically located a distance of one-half of a wavelength from the opening 126.

The filter 100 may be thought of as having two components. The first component is formed by the input port 102 and resonant cavities 106 and 108. The first component uses positive coupling to couple electromagnetic energy from the input port 102 to the resonant cavities 106 and 108. Positive coupling means that electromagnetic energy from the input port 102 is coupled into each of the resonant cavities 106 and 108 with the same phase. Positive coupling is achieved by disposing the resonant cavities 106 and 108 equidistant from the input port 102. The second component of the filter 100 is formed by the resonant cavities 110 and 112 and the output port 104. The second component uses negative coupling to couple electromagnetic energy from the resonant cavities 110 and 112 to the output port 104. Negative coupling means that electromagnetic energy from resonant cavity 110 to the output port 104 is 180° out of phase with electromagnetic energy from the resonant cavity 112 to the output port 104. Negative coupling is achieved by disposing the resonant cavities 110 and 112, and their respective openings openings 126 and 128, one-half wavelength apart with respect to the output port 104.

Figure 28:
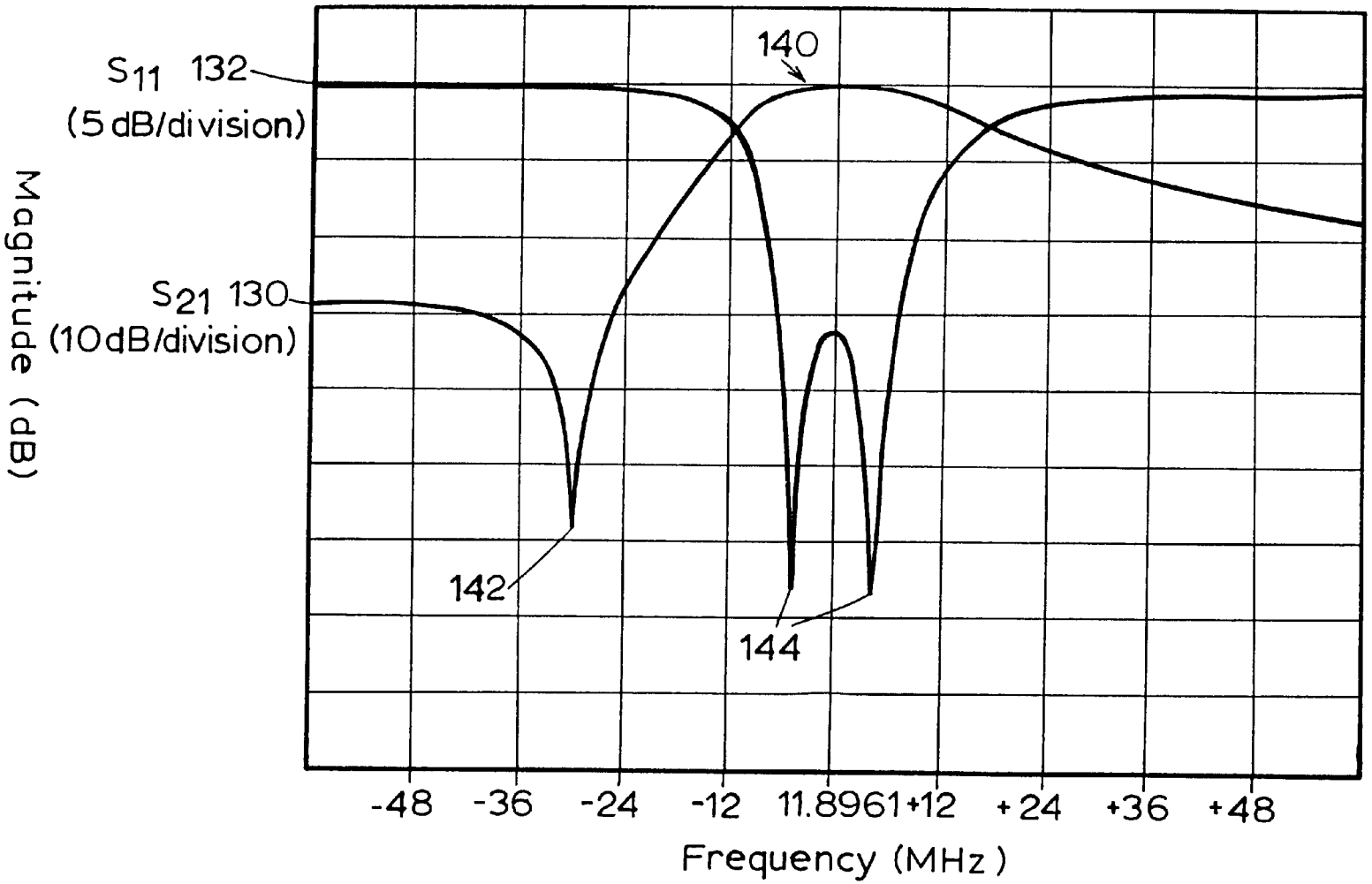
FIGS. 28 and 29 are plots of S-parameters of the filter of FIG. 18.
Figure 29:
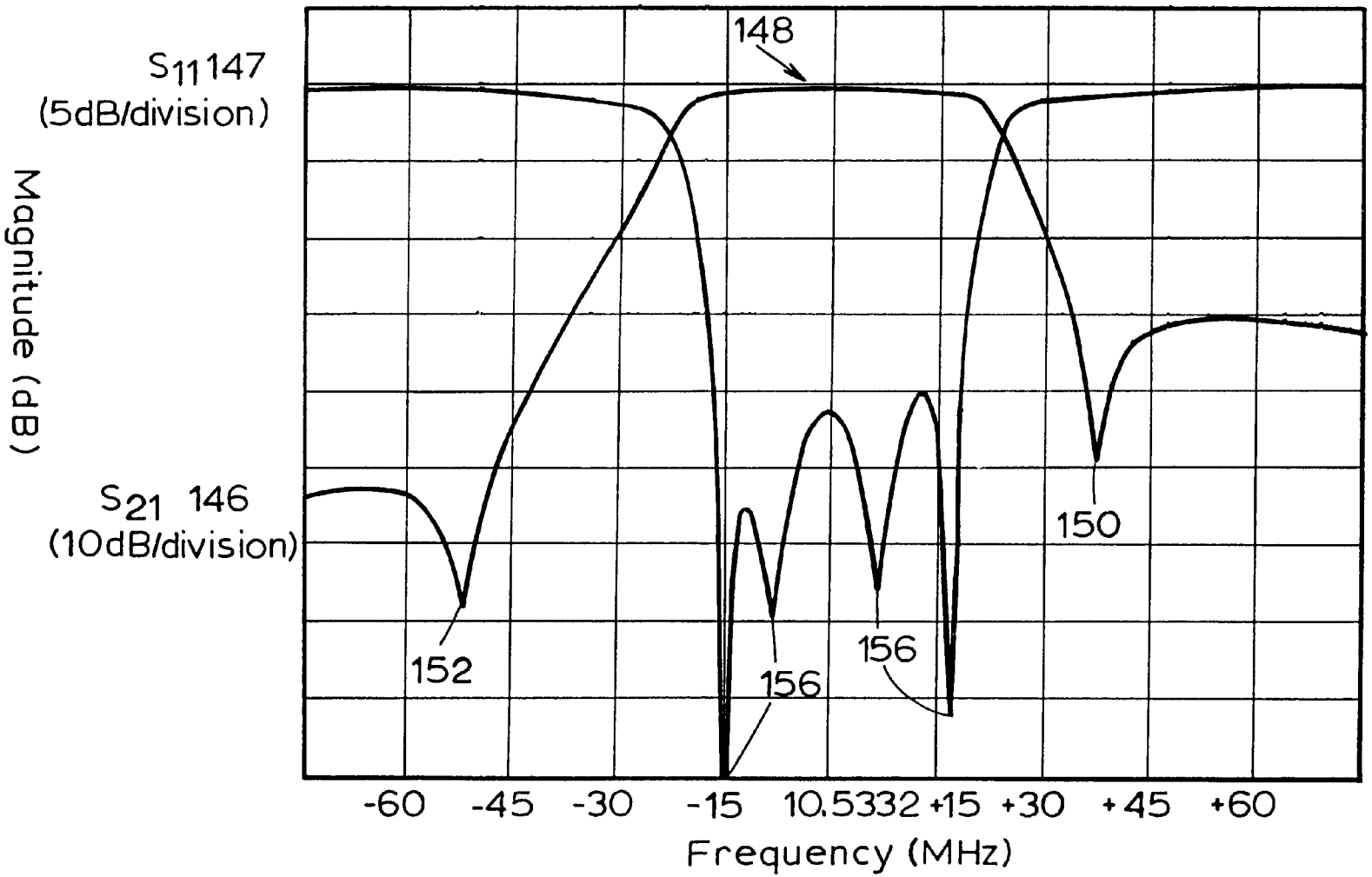

FIGS. 28 and 29 are transfer characteristics (or S-parameters) that represent the frequency response of two filters that are constructed in accordance with the present invention. As will be readily appreciated by those skilled in the art transfer characteristics such as those shown in FIGS. 28 and 29 are typically generated using equipment such as a network analyzer. A network analyzer outputs a continuous wave radio frequency (RF) signal that sweeps a frequency range. The output signal from the network analyzer is generally coupled into an input port. As the network analyzer generates the output signal, it measures a signal at another port (e.g., the output port). The network analyzer then computes a ratio of the output signal at each frequency to the measured signal at each frequency. Two typical measurements that are performed using a network analyzer are $S_{21}$ (insertion loss), which is a ratio of a signal output from port 2 (e.g., the output port) to a signal input to port 1 (e.g., the input port), and $S_{11}$ (return loss), which is a ratio of a signal output from port 1 (e.g, the input port) to a signal input to port 1 (e.g., the input port). As will be appreciated by those skilled in the art, after the network analyzer calculates the ratios it displays them as shown in FIGS. 28 and 29.

Referring to FIG. 28, the S-parameters of the resonant cavities 106, 108 that form the first component of the filter 100 are shown. For measurement purposes, electromagnetic energy is coupled into the input port 102 and the output from opening 122 is measured and plotted as a ratio to the energy coupled into the input port 102 by the network analyzer. The S-parameters represent the frequency response of the resonant cavities 106, 108 that are connected to the input port 102 and tuned to 11.8961 GHz. FIG. 28 shows two traces, $S_{21}$ 130 (insertion loss), which is the ratio of the energy measured at opening 122 to the energy input into the input port 102, and $S_{11}$ 132 (return loss), which is the ratio of the energy measured at the input port 102 to the energy input into the input port 102. The vertical scales, which represent measured and input signal ratio magnitude, for $S_{21}$ 130 and $S_{11}$ 132 are 10 and 5 decibels (dB) per division, respectively. The center of the horizontal axis is 11.8961 GHz and the horizontal span of the transfer characteristic is 120 MHz (0.12 GHz), which means that each horizontal division represents 12 MHz (0.012 GHz). Accordingly, the horizontal dimensions are noted as frequencies with respect to 11.8961 GHz.

$S_{21}$ 130 represents the frequency spectrum of a signal that is output from resonant cavity 108 at opening 122, based on the signal input into the input port 102. $S_{21}$ 130 indicates that a passband 140 of approximately 0.02 GHz bandwidth is centered at 11.8961 GHz, which means that signals within the passband will pass through the first component of the filter 100 with little attenuation. Conversely, a transmission pole 142 of approximately 58 dB below the passband is located at approximately 30 MHz below 11.8961 GHz (11.8661 GHz), which indicates that signals at approximately 11.8661 GHz will be attenuated by 58 dB with respect to a signal that is within the passband 140. The transmission pole 142 location and shape as shown in $S_{21}$ 130 of FIG. 28 indicates that the first component of the filter 100 has a low side filtering characteristics, meaning that significant filtering only takes place at frequencies below the passband 140 and that signal having frequencies above the passband 140 will not be attenuated significantly. The transmission pole 142 for the first component of the filter 100 on the low side of the passband 140 is due to the positive coupling between the resonant cavities 106, 108 and the input port 102. The first component of the filter 100 has very low return loss within the passband 140. Conversely, return loss outside of the passband 140 is very high. As shown, $S_{11}$ 132 has two spikes 144 that are caused by the two resonant cavities 106, 108.

As previously noted, the transfer characteristic between the resonant cavity 108 and the resonant cavity 110 has a low side transmission pole 142 due to positive coupling. Resonant cavities 110 and 112 have negative coupling with respect to the output port 104. Negative coupling creates a high side transmission pole in a transfer characteristic. Accordingly, when energy is coupled from the resonant cavity 108 into the second component of the filter 100, a transfer characteristic having two transmission poles is (one on the high side of the passband and one on the low side of the passband) created.

FIG. 29 shows the S-parameters of a filter 100 constructed as shown in FIGS. 20–27. FIG. 29 includes plots of $S_{21}$ 146, which is the ratio of the energy measured at the output port 104 to the energy input into the input port 102, and $S_{11}$ 147, which is the ratio of the energy measured at the input port 102 to the energy input into the input port 102. The resonant cavities 106–112 are turned to 10.5332 GHz. Accordingly, the plots shown in FIG. 29 are centered at 10.5332 GHz and each horizontal division is 15 MHz. The vertical scale of $S_{21}$ 146 and $S_{11}$ 147 are 10 and 5 dB/division, respectively. $S_{11}$ 147 represents the return loss of the filter 100. FIG. 29 is a plot of the S-parameters of a filter designed in accordance with the present invention, wherein the transfer S-parameters represent the total frequency response of a filter 100 that has its resonant cavities 106–112 tuned to 10.5332 GHz. $S_{21}$ 146 of FIG. 29 represents the frequency response at the output port 104 based on electromagnetic energy introduced to the input port 102. The frequency response indicates that there is a passband 148 at 10.5332 GHz and that there is a high side transmission pole 150 that is created due to the negative coupling of resonant cavities 110, 112 with the output port 104. The transfer characteristic also indicates that there is a low side transmission pole 152 that is created by positive coupling between the input port 102 and the resonant cavities 106, 108. The response from the negative coupling, combined with the response from the positive coupling creates an overall frequency response that has both high and low side filtering and thus creates a bandpass filter frequency response characteristic.

$S_{11}$ 147 of FIG. 29 represents the return loss of a filter 100 constructed as shown in FIG. 29. $S_{11}$ 147 includes four spikes 156, high and low side transmission poles, 150, 152, respectively, that are caused by the four resonant cavities 106–112 of the filter 100. Although FIG. 29 was taken from a different filter than yielded FIG. 28, one skilled in the art will readily appreciate that the combination of positive and negative coupling, as taught herein, would be applicable to any frequency of resonators and would result in both high and low side transmission poles.

Figure 30:
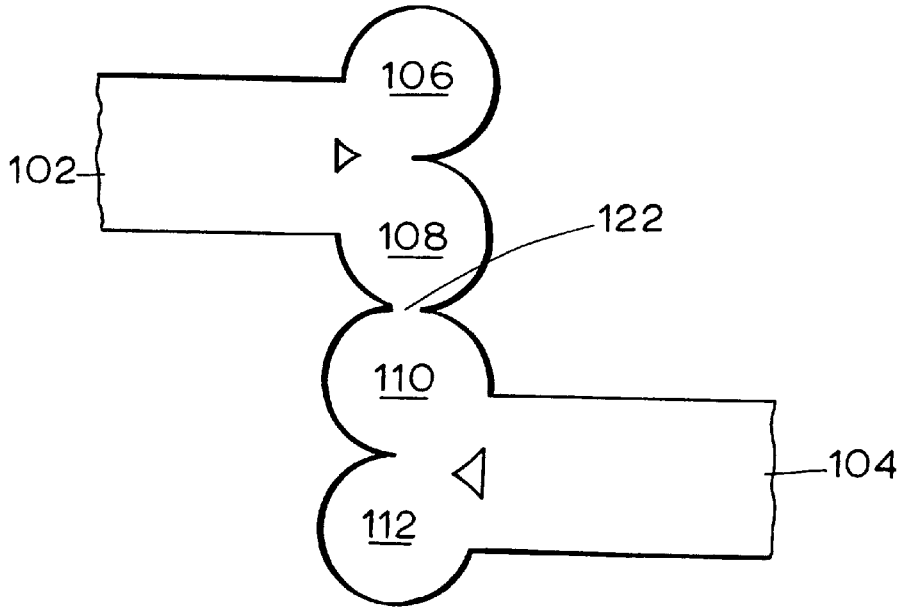
FIG. 30 is a schematic diagram of an alternative embodiment of a cavity-coupled filter having input and output ports positively coupled to resonators.
Figure 31:
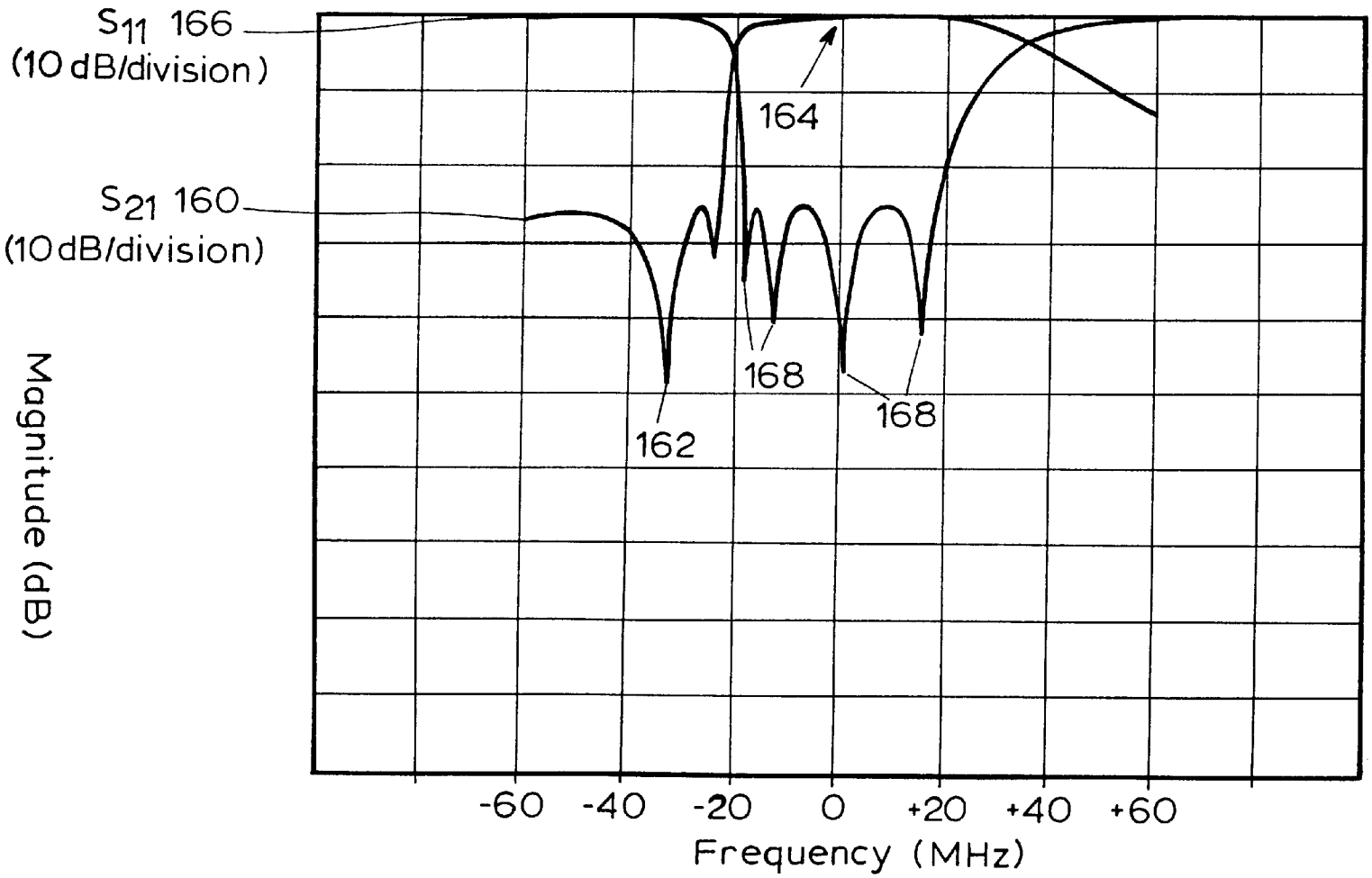
FIG. 31 is a plot of S-parameters of the filter of FIG. 30.

In other embodiments, two positive coupling components may be connected to create a filter response that has an enhanced low side transmission pole and no high side transmission pole. FIG. 30 illustrates one such embodiment wherein the input port 102 is positively coupled to resonant cavities 106 and 108 and the output port 104 is positively coupled to resonant cavities 110 and 112. An opening 122 couples resonant cavity 108 to resonant cavity 110. The S-parameters of a filter that is constructed in a manner similar to that shown in FIG. 30 are shown in FIG. 31. As shown in FIG. 31, $S_{21}$ 160 has a low side transmission pole 162 that is on the low side of the pass band 164 and has a steeper slope up to the passband 164 than the low side transmission poles shown in FIGS. 28 or 29. The use of two positively coupled components enhances the low side filtering characteristics of a filter. $S_{11}$ 166 shows a plot of the return loss, which has four spikes 168 that are caused by the four resonant cavities 106–112.

Figure 32:
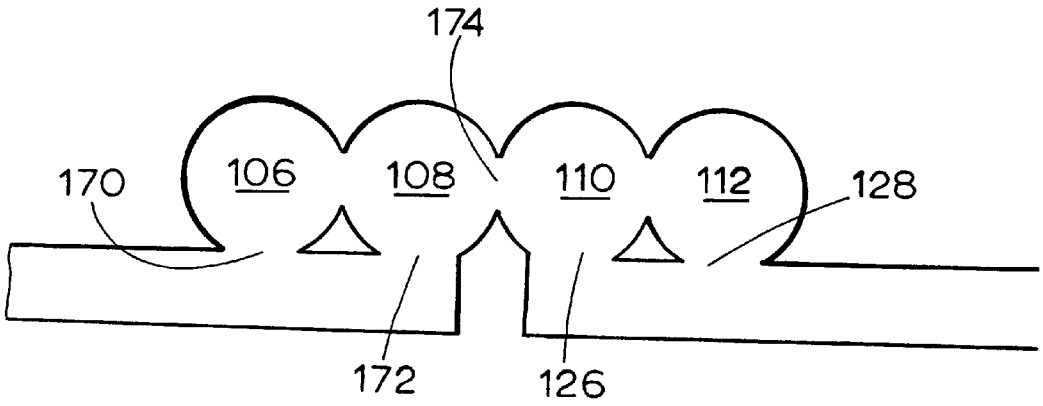
FIG. 32 is a schematic diagram of an alternate embodiment of a cavity-coupled filter having input and output ports negatively coupled to resonators.
Figure 33:
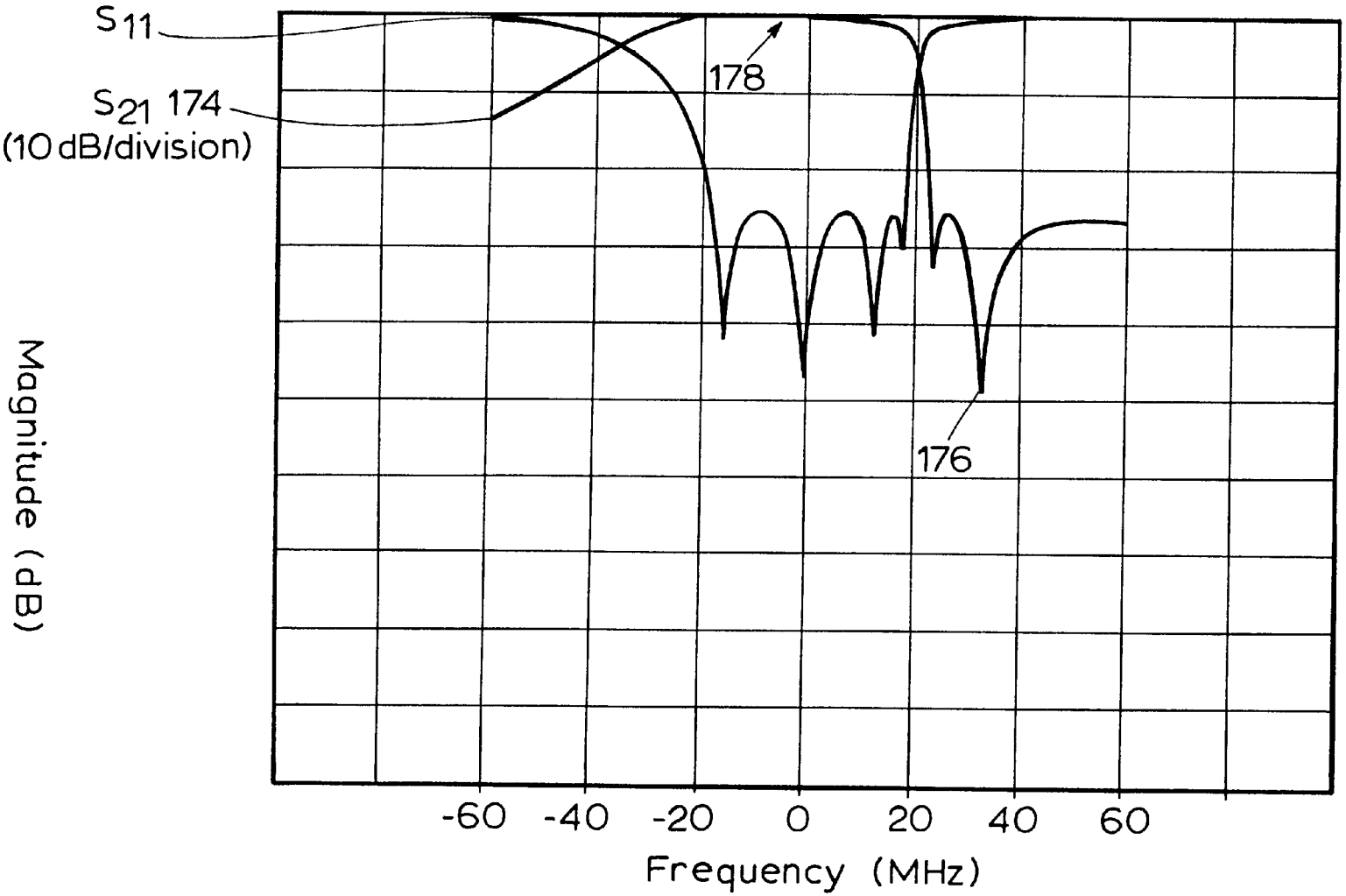
FIG. 33 is a plot of S-parameters of the filter of FIG. 32.

Similarly, FIG. 32 shows two negative coupling components connected to create a filter response that has an enhanced high side transmission pole and no low side transmission pole. The input port 102 is connected to resonant cavities 106 and 108 by openings 170 and 172, respectively. Resonant cavity 108 is, in turn, connected to resonant cavity 110 by opening 174. Just like the embodiment described in conjunction with FIG. 20, resonant cavities 110 and 112 are coupled to the output port 104 via openings 126 and 128, respectively. Openings 170 and 172 are separated by one-half wavelength and openings 126 and 128 are also separated by one-half wavelength. As shown in FIG. 33, the insertion loss $S_{21}$ 174 of the filter has an enhanced high side transmission pole 176 that is on the high side of a passband 178. Again, note that the slope between the high side transmission pole 176 and the passband 178 is stepper than shown in FIGS. 28 or 29.

Figure 34:
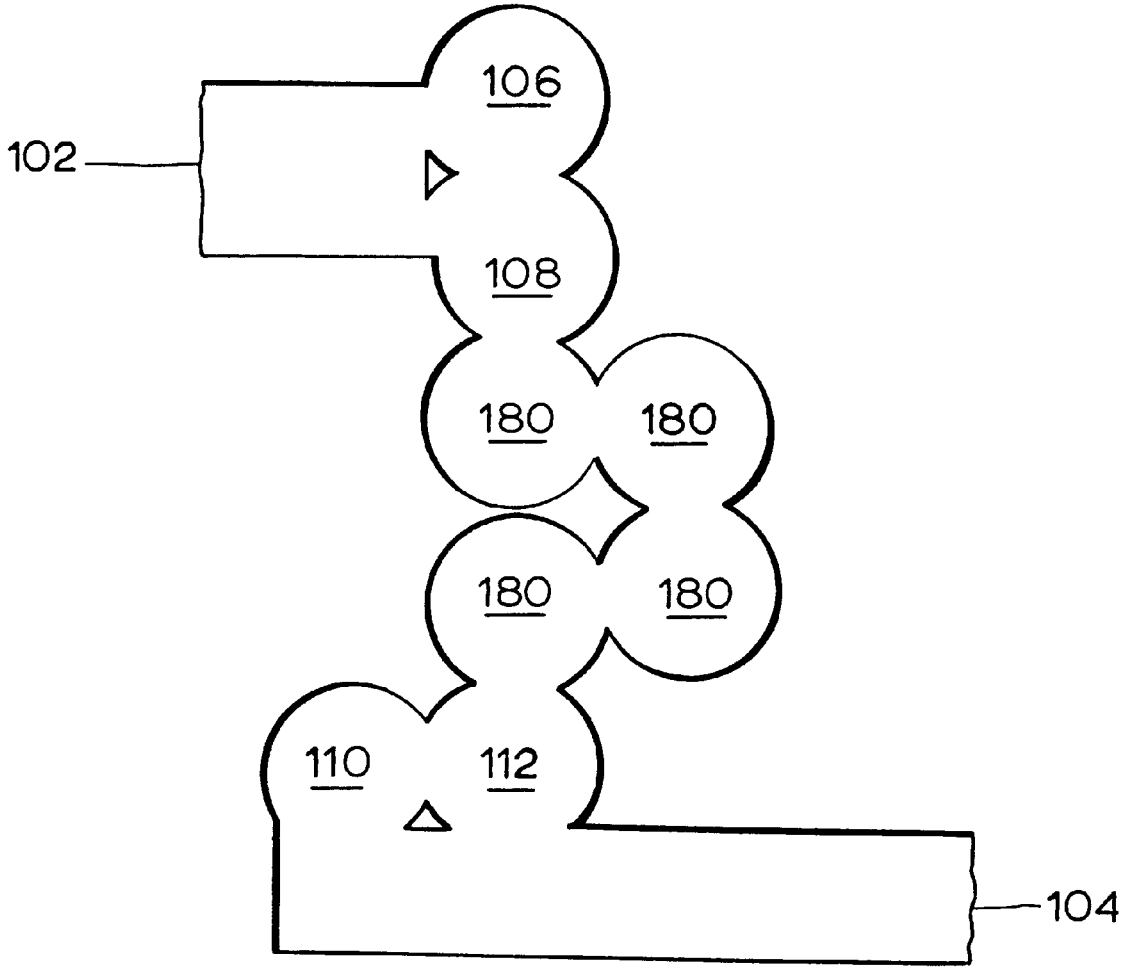
FIG. 34 is a schematic diagram of an alternate embodiment of a higher order cavity-coupled filter having additional resonators.
Figure 35:
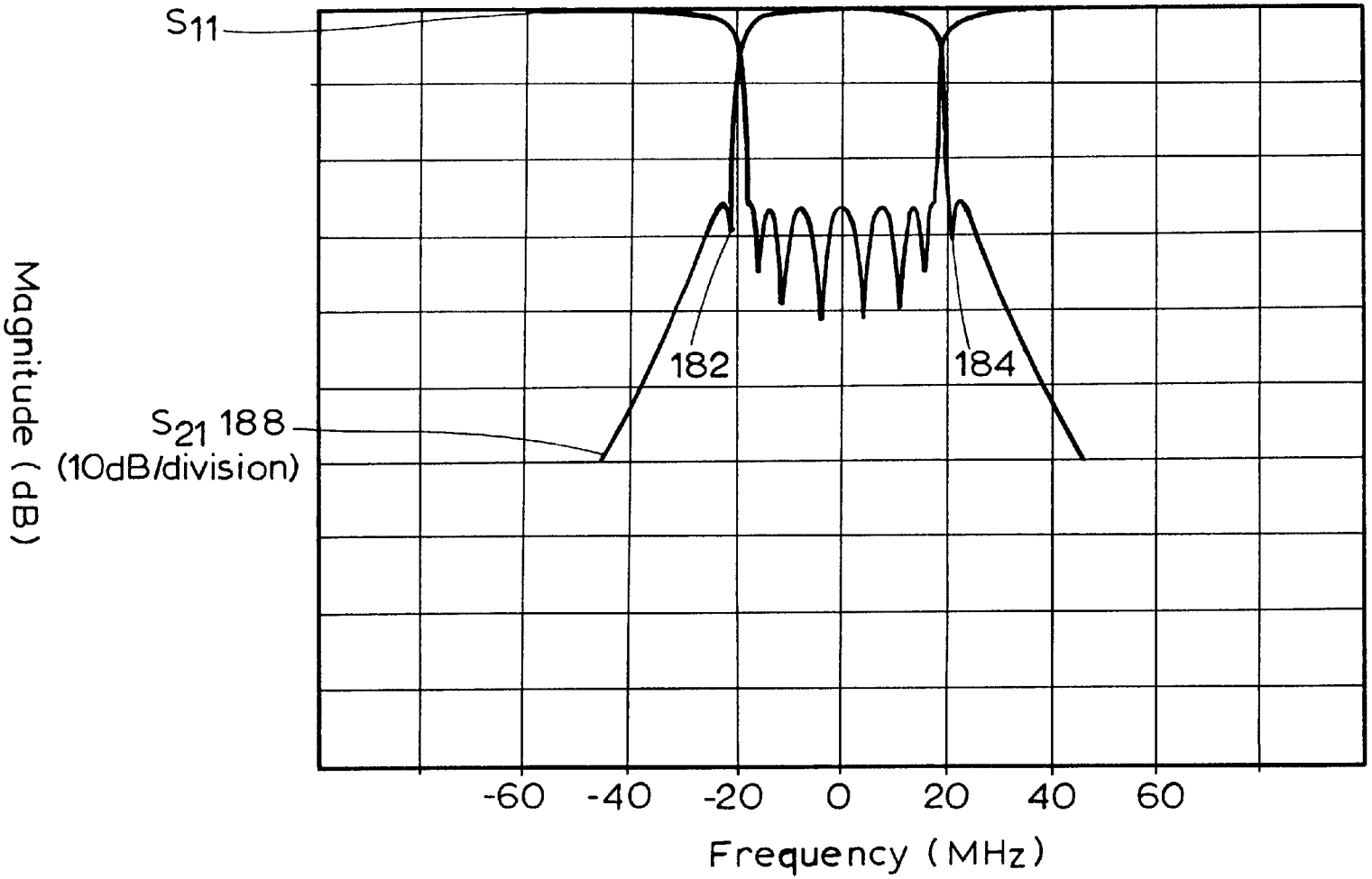
FIG. 35 is a plot of S-parameters of the filter of FIG. 34.

As will be appreciated by those skilled in the art, the teachings of the present invention (i.e., using positive and negative coupling to create high and low side transmission poles) may be applied to higher order filters that use more than four resonant cavities. As shown in FIG. 34, multiple resonant cavities 180 may be added between resonant cavities 108 and 112 and the output port 104. Additional resonant cavities increase the rejection of the filter outside of the transmission poles. For example, as shown in FIG. 31, the magnitude of the insertion loss $S_{21}$ 160 rapidly increases at frequencies below the frequency at which the low side transmission pole 162 is located. Similarly, as shown in FIG. 33, the magnitude of the insertion loss $S_{21}$ 174 rapidly increases at frequencies above the frequency at which the high side transmission pole 176 is located. FIG. 35 is a plot of the S-parameters of a filter constructed as shown in FIG. 34. Note that the magnitude of the insertion loss $S_{21}$ 188 decreases at frequencies below the frequency at which a low side transmission pole 182 is located and decreases at frequencies above the frequency at which a high side transmission pole 184 is located.

Note that the center frequencies for the S-parameters shown in FIGS. 31, 33 and 35 have not been specified because, as one skilled in the art will readily appreciate, it is the shape or characteristic of the response that is of interest. One skilled in the art will appreciate that the center frequencies of the S-parameters shown in FIGS. 31, 33 and 35 can be easily specified or changed by changing the operating frequencies of the resonators 106–112.

While the present invention has been described with reference to the specific examples, which are intended to be illustrative only and not to be limiting of the invention, it will be apparent to those of ordinary skill in the art that changes, additions, and/or deletion may be made to the disclosed embodiment without departing from the spirit and scope of the invention. For example, additional resonant cavities may be added to any of the foregoing embodiments to enhance the frequency response of the filter. Additionally, any combination of positive and negative coupling components may be used to create a desired transmission pole or poles.

What is claimed is:

1. A coupled-cavity microwave filter, comprising:

an input port;

a first resonator having a first opening immediately adjacent the input port, wherein the first opening receives electromagnetic energy directly from the input port;

a second resonator having a second opening immediately adjacent the input port, wherein the second opening receives electromagnetic energy directly from the input port and wherein the first resonator and the second resonator are directly electromagnetically coupled to each other;

an output port;

a third resonator having a third opening immediately adjacent the output port, wherein the second resonator and the third resonator are electromagnetically coupled;

a fourth resonator having a fourth opening immediately adjacent the output port, wherein the fourth opening transfers electromagnetic energy directly to the output port and wherein the third resonator and the fourth resonator are directly electromagnetically coupled to each other; and wherein the first and second resonators are indirectly coupled to the output port through the third and fourth resonators.

2. The coupled-cavity microwave filter of claim 1, wherein the first opening is a first distance from the input port and the second opening is a second distance from the input port.

3. The coupled-cavity microwave filter of claim 2, wherein the third opening is a third distance from the output port and the fourth opening is a fourth distance from the output port.

4. The coupled-cavity microwave filter of claim 3, wherein the first distance is approximately equal to the second distance.

5. The coupled-cavity microwave filter of claim 3, wherein a difference between the first distance and the second distance is approximately one-half of a wavelength at which the first and second resonators operate.

6. The coupled-cavity microwave filter of claim 3, wherein the third distance is approximately equal to the fourth distance.

7. The coupled-cavity microwave filter of claim 3, wherein a difference between the third distance and the fourth distance is approximately one-half of a wavelength at which the third and fourth resonators operate.

8. The coupled-cavity microwave filter of claim 1, wherein the second resonator is directly coupled to the third resonator.

9. The coupled-cavity microwave filter of claim 1, wherein the second resonator is coupled to the third resonator through a plurality of resonators.

10. The coupled-cavity microwave filter of claim 9, wherein the plurality of resonators comprises four resonators.

11. The coupled-cavity microwave filter of claim 1, wherein the first, second, third and fourth resonators are tuned to operate at approximately a single frequency.

12. The coupled-cavity microwave filter of claim 1, wherein the first and second resonators are electomagnetically coupled through an opening.

13. The coupled-cavity microwave filter of claim 12, further comprising a tuning screw disposed in the opening and adapted to adjust the electromagnetic coupling between the first and second resonators.

14. The coupled-cavity microwave filter of claim 1, wherein the third and fourth resonators are electomagnetically coupled through an opening.

15. The coupled-cavity microwave filter of claim 14, further comprising a tuning screw disposed in the opening and being adapted to adjust the electromagnetic coupling between the third and fourth resonators.

16. The coupled-cavity microwave filter of claim 1, further comprising tuning screws, wherein the tuning screws are disposed in each of the first, second, third and fourth openings.

* * * * *